US005579693A

United States Patent [19]

Carreira et al.

[11] Patent Number: 5,579,693

[45] Date of Patent: Dec. 3, 1996

[54] CURL CONTROL OF PRINTED SHEETS

[75] Inventors: Leonard M. Carreira; Arthur M. Gooray; Kenneth C. Peter, all of Penfield, N.Y.

[73] Assignee: Xerox Corporation, Stamford, Conn.

[21] Appl. No.: 353,870

[22] Filed: Dec. 12, 1994

[51] Int. Cl.[6] ..... B41F 35/00

[52] U.S. Cl. ..... 101/424.1; 101/487

[58] Field of Search ..... 101/424.1, 487, 101/488, 483, 484

[56] References Cited

U.S. PATENT DOCUMENTS

| | | | |
|---|---|---|---|
| 567,878 | 9/1896 | Hamilton et al. | 101/483 |
| 2,420,739 | 5/1947 | Dorsch | 101/424.1 |
| 2,980,015 | 4/1961 | Zentner et al. | 101/487 |
| 4,434,562 | 3/1984 | Bubley et al. | 101/424.1 |
| 4,652,604 | 3/1987 | Walls et al. | 522/63 |
| 4,853,255 | 8/1989 | Onishi et al. | 427/148 |
| 5,169,437 | 12/1992 | You | 106/20 D |
| 5,277,965 | 1/1994 | Malhotra | 428/216 |
| 5,345,863 | 9/1994 | Kurata et al. | 101/126 |
| 5,349,905 | 9/1994 | Taylor et al. | 101/488 |
| 5,373,312 | 12/1994 | Fujioka et al. | 101/424.1 |
| 5,423,260 | 6/1995 | Goldberg et al. | 101/424.1 |
| 5,429,046 | 7/1995 | Shiba et al. | 101/148 |

*Primary Examiner*—Edgar S. Burr
*Assistant Examiner*—Anthony H. Nguyen
*Attorney, Agent, or Firm*—Daniel J. Krieger

[57] ABSTRACT

A method and apparatus for controlling curl in a liquid ink printer. The liquid ink printer deposits an anticurl material on the side of a printed sheet opposite the one having printing deposited thereon. The anticurl material is a fluid which counteracts the steady state curl in the direction of the printed image resulting from active drying of the printed sheet. The back side of a printed sheet has deposited thereon an anticurl fluid which can contain water, a penetrant, and a humectant like material such as diethylene glycol, ethylene glycol, sulfolane and glycerin. The anticurl material is deposited with a roller made of a foam material for absorbing the anticurl fluid or a roller having dimples disposed on the surface thereof. In addition, the anticurl fluid can be deposited by a spray device or a thermal ink jet printhead ejecting anticurl fluid.

17 Claims, 6 Drawing Sheets

CURL CONTROL OF PRINTED SHEETS

FIELD OF THE INVENTION

This invention relates generally to printing in a liquid ink printer and more particularly to controlling the amount of curl resulting from actively drying printed sheets printed with liquid ink.

BACKGROUND OF THE INVENTION

An ink-jet printer of the type frequently referred to as drop-on-demand, has at least one printhead from which droplets of ink are directed towards a recording medium. Within the printhead, the ink is contained in a plurality of channels. Power pulses-cause the droplets of ink to be expelled as required, from orifices or nozzles at the end of the channels.

In a thermal ink-jet printer, the power pulses are usually produced by resistors, each located in a respective one of the channels, which are individually addressable to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink thereby forming a droplet moving in a direction away from the channel orifice and towards the recording medium. The channel is then refilled by capillary action, which in turn draws ink from a supply container of liquid ink. Operation of a thermal ink-jet printer is described in, for example, U.S. Pat. No. 4,849,774.

The ink-jet printhead may be incorporated into either a carriage-type printer or a page-width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time, on a stationary recording medium, such as paper or a transparency. After the swath is printed, the paper is stepped a distance equal to the height of the printed swath, or a portion .thereof, so that the next printed swath is contiguous or overlapping therewith. The procedure is repeated until the entire page is printed. In contrast, the page-width printer includes a stationary printhead having a length equal to or greater than the width of the paper. The paper is continually moved past the page-width printhead in a direction normal to the printhead length and at a constant speed during the printing process.

Many liquid inks and particularly those used in thermal ink jet printing, include a colorant or dye and a liquid which is typically an aqueous liquid vehicle, such as water. Some thermal ink jet inks also include a low vapor pressure solvent. When a substrate or a sheet of paper is printed with ink-jet ink, the ink is deposited on the substrate to form an image in the form of text and/or graphics. Once deposited, the liquid is removed from the ink and the paper to fix the colorant to the substrate. The amount of liquid to be removed, of course, varies with the amount of ink deposited on the substrate. For instance, the amount of liquid to be removed from a sheet of paper with 10% printing, as in text only printing, is quite small. If the sheet is covered with 90% printing, however, as when a graphic image is printed, the amount of liquid to be removed is substantially more and can cause image deformation and paper deformation if not properly removed.

The liquid component can be removed from the ink and printed substrate by a number of methods. One simple method is natural air drying in which the liquid component of the ink deposited on the substrate is allowed to evaporate and penetrate into the substrate naturally without mechanical assistance. Another method is to send the printed substrate through a dryer to actively evaporate the liquid. Active drying of printed substrates includes infrared heating, conductive heating and heating by microwave energy. In some cases, a special paper is used in which the liquid is absorbed by a thin coating of absorptive material deposited on the surface of the paper. Blotting of the printed substrate is also known.

While active drying is not essential, it is necessary in high speed printing, where printed images must be actively dryed to enable faster printing speeds. The absorption and desorption of water into and out of the paper, however, has some undesirable side effects, such as strike through, leathering at the edges of the printed image, paper cockle, and paper curl. Paper curl is a function of the amount of liquid deposited per unit area of recording medium. Less printing on a page has less potential to develop curl due to the smaller amount of liquid. More printing on a page has more curl potential due to a higher amount of liquid per unit area.

Generally, the term "curl" refers to the distance between the base line of the arc formed by a recording sheet when viewed in crosssection across its width (or shorter dimension—for example, 8.5 inches in an 8.5×11 inch sheet, as opposed to length, or longer dimension—for example, 11 inches in an 8.5×11 inch sheet) and the midpoint of the arc. This type of curl applies to long grain cut paper, since curl is typically perpendicular to the process direction of a paper making machine. To measure curl, a sheet can be held with the thumb and forefinger in the middle of one of the short edges of the sheet (for example, in the middle of one of the 8.5 inch edges in an 8.5×11 inch sheet) and the arc formed by the sheet can be matched against a pre-drawn standard template curve. Such curl measurement is referred to as "hanging radius curl."

Application of liquid inks, containing water, to paper causes an initial hydroexpansion of the fibers of the paper. This initial hydroexpansion causes an expansion curl away from the image which occurs typically right after printing. Steady state curl, also known as cool curl, is toward the image, and typically occurs over a period of time when the sheet tries to achieve a state of final stress release after being dryed. Active drying accelerates the effect of towards the image curl or steady state curl.

The amount of time that it takes for a sheet of paper to reach steady state, depends on the amount and type of penetrants, co-solvents and humectants which are inherent in the ink being used. Penetrants change the depth of ink penetration and thus modify the amount of time taken to reach steady state curl. It is also known that co-solvent humectant ethylene glycol inks which contain no penetrant or salt remain essentially flat. Ethylene glycol inks, however, appear to produce a long term hydroexpansion that reduces or counteracts the stress relaxation of the sheet. This effect, however, is lost over time to produce a final towards the image curl.

In U.S. Pat. No. 4,853,255 to Onishi et al., a process for controlling curl in a web of coated paper is described. A paper web is unwound from a reel and coated with a coating composition applied to one side of the web. Water is applied to the opposite side of the coated paper to thereby control curl resulting from the coating composition previously applied.

U.S. Pat. No. 5,277,965 to Malhotra, describes a recording sheet which includes an ink receiving layer, a base sheet, a heat absorbing layer, and an anticurl layer. The recording sheet exhibits little or no curling, even after exposure to heat and/or a wide range of relative humidities.

SUMMARY OF THE INVENTION

In accordance with one aspect of the present invention, there is provided a printing machine of the type in which liquid ink is deposited on a surface of a recording medium moving along a path. The printing machine includes a dryer disposed in the path drying the liquid ink deposited on the surface of the recording medium and an applicator disposed adjacent to the path depositing an anticurl material on another surface of the recording medium.

Pursuant to another aspect of the present invention, there is provided a method for reducing curl in a recording medium having deposited on a surface thereof liquid ink. The method includes the steps of applying an anticurl material to another surface of the recording medium and drying the recording medium after the applying step.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
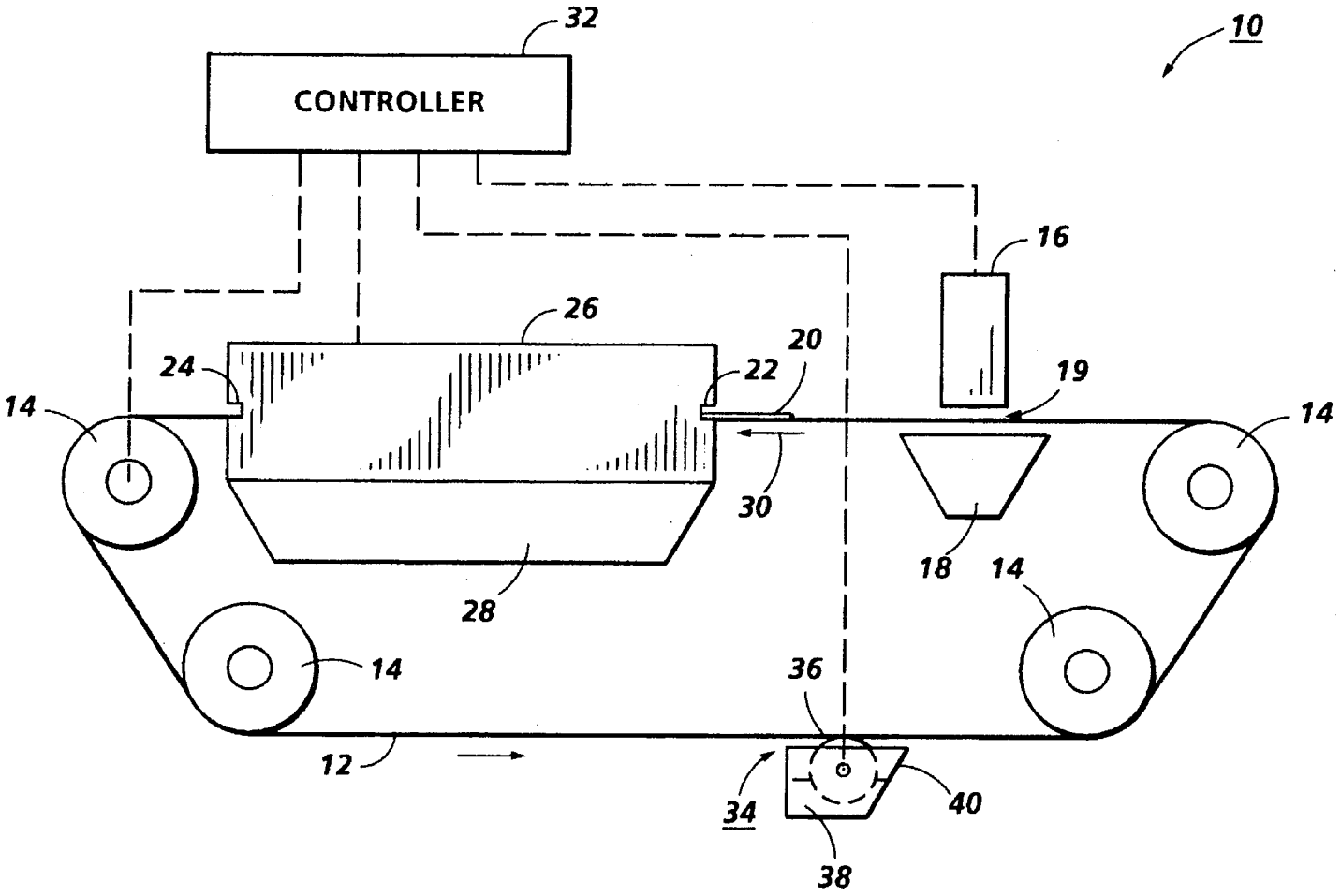
FIG. 1 is a schematic side elevational view of one embodiment of an ink-jet printer having an anticurl applicator.

FIG. 1 illustrates a schematic side view of an ink-jet printer 10. The ink-jet printer 10 includes an input tray (not shown) containing cut sheets of paper stock or transparencies to be printed on by the ink jet printer. Individual sheets of paper are removed from the input tray and fed onto a transport belt 12 driven by rollers 14 beneath a printing member 16. The transport belt 12 is substantially transparent to microwave energy and includes a plurality of holes through which a vacuum is applied to hold the printing sheet to the belt as it moves through the printer. The printing member 16 includes one or more page width ink-jet printheads which deposit liquid ink on a sheet of paper as the belt 12 carries the sheet of paper past the printing member 16. The page width ink-jet printhead includes a linear array of print nozzles as wide as the sheet of paper so that ink is deposited across the entire width of a sheet. The present invention is equally applicable, however, to printers having an ink-jet printhead which moves across the sheet periodically in swaths, to form the image. The print member 16 includes an ink supply which may either be located with the printhead itself or may be located elsewhere and connected to the printhead through an ink conduit. In addition to an ink supply, the print member 16 includes the necessary electronics to control the deposition of ink on the sheet.

During printing, an individual sheet of paper is held to the transport belt 12, through a printing zone 19, by an applied vacuum from a first vacuum applicator 18. Once printed, the printed sheet 20 enters an input slot 22 and exits an output slot 24 of a dryer 26. The dryer 26 has attached thereto a second vacuum applicator 28 for further application of a vacuum to the printed sheet of paper 20 to the belt 12 as it traverses through the dryer 26 in the direction of an arrow 30. Once the printed sheet 20 has been dried by the dryer 26, it exits the output slot 24 and is deposited in an output tray (not shown).

A controller 32 controls the printing member 16, the dryer 26, and the rollers 14 as would be understood by one skilled in the art. In addition, an adaptive dryer control for controlling the speed of the belt 12 through the dryer 26 can also be used. U.S. Pat. No. 5,214,442entitled "Adaptive Dryer Control for Ink-Jet Processors", assigned to Xerox Corporation, discloses such an adaptive dryer control and is hereby incorporated by reference.

In the present embodiment of the invention, the dryer 26 includes a microwave dryer applying microwave energy to dry the ink deposited on the printed sheet 20. A microwave dryer suitable for use in the present invention is described in U.S. patent application No. 08/159,908 entitled "Apparatus and Method for Drying Ink Deposited by Ink-Jet Printing" assigned to Xerox Corporation and filed Nov. 30, 1993, the relevant portions of which are incorporated herein by reference. Since a microwave dryer is being used, ink specially formulated to be heated by microwave energy is preferred. Such ink may include compounds designed to couple with the microwave energy for increasing the amount of heat conducted thereby. One such compound is an ionic compound at least ionizable in the liquid vehicle. U.S. Pat. No. 5,220,346 entitled "Printing Processes with Microwave Drying" assigned to Xerox Corporation, discloses a suitable ink and is hereby incorporated in this application by reference.

It has been found that actively dried printed sheets exhibit some amount of steady state curl in the direction towards the image. In particular, microwave drying can result in an unacceptable steady state curl subsequent to printing if no ethylene glycol is present in the ink formulation. While a certain amount of curl is unacceptable, typically any curl having a hanging radius curl of less than a 12" radius is unacceptable. Consequently, some inks have been formulated which include ethylene glycol which produces a fairly flat sheet or one having a very small away from image process curl and which over a period of time results in little or no steady state curl towards the image. Not all inks, however, contain ethylene glycol or other materials which can either prevent or reduce the amount of towards the image curl. Therefore, it is important to control the steady state curl, since relatively flat sheets of printed paper are desired by the consumer. It has also been found that duplex printed sheets do not typically exhibit any type of towards the image curl because of stress relief on both sides of the sheet. Also, printing on a substrate that is exposed to high relative humidity, for instance, the substrate has a 10% moisture content by weight, results in lower levels of steady state curl. Likewise, simplex printed sheets containing only text also typically do not incur towards the image curl. Towards the image curl has, however, been found in printed images on simplex printed sheets which include a certain amount Of ink mass such as those having heavy text or those having monochrome graphics or a maximum of full color.

To reduce or prevent steady-state curl, the present invention includes an anticurl material applicator 34. The anticurl material applicator 34 includes a material application roller 36 which may or may not be in contact with the transport belt 12 depending on the type of medium being recorded upon and the amount of ink being deposited thereon. The anticurl applicator 34 is moved into and out of contact with the belt 12 under control of the controller 32 and an appropriate mechanical mechanism (not shown). In addition, the roller 36 is also rotated under control of the controller 32 to apply a certain amount of anticurl material 38 held by a trough or receptacle 40.

The anticurl material 38 is typically a fluid which could simply be water. In addition to water, however, the anticurl material could contain a microwave coupler such as salt, a penetrant, and a humectant like material such as diethylene glycol, ethylene glycol, polyethylene glycol, sulfolane, glycerine, and others known by those skilled in the art. Likewise, timethylol propane (TMP) or other triols may also be used. The anticurl material could also include all the constituents of the ink except for the dye such as a substantially clear liquid ink.

Figure 2:
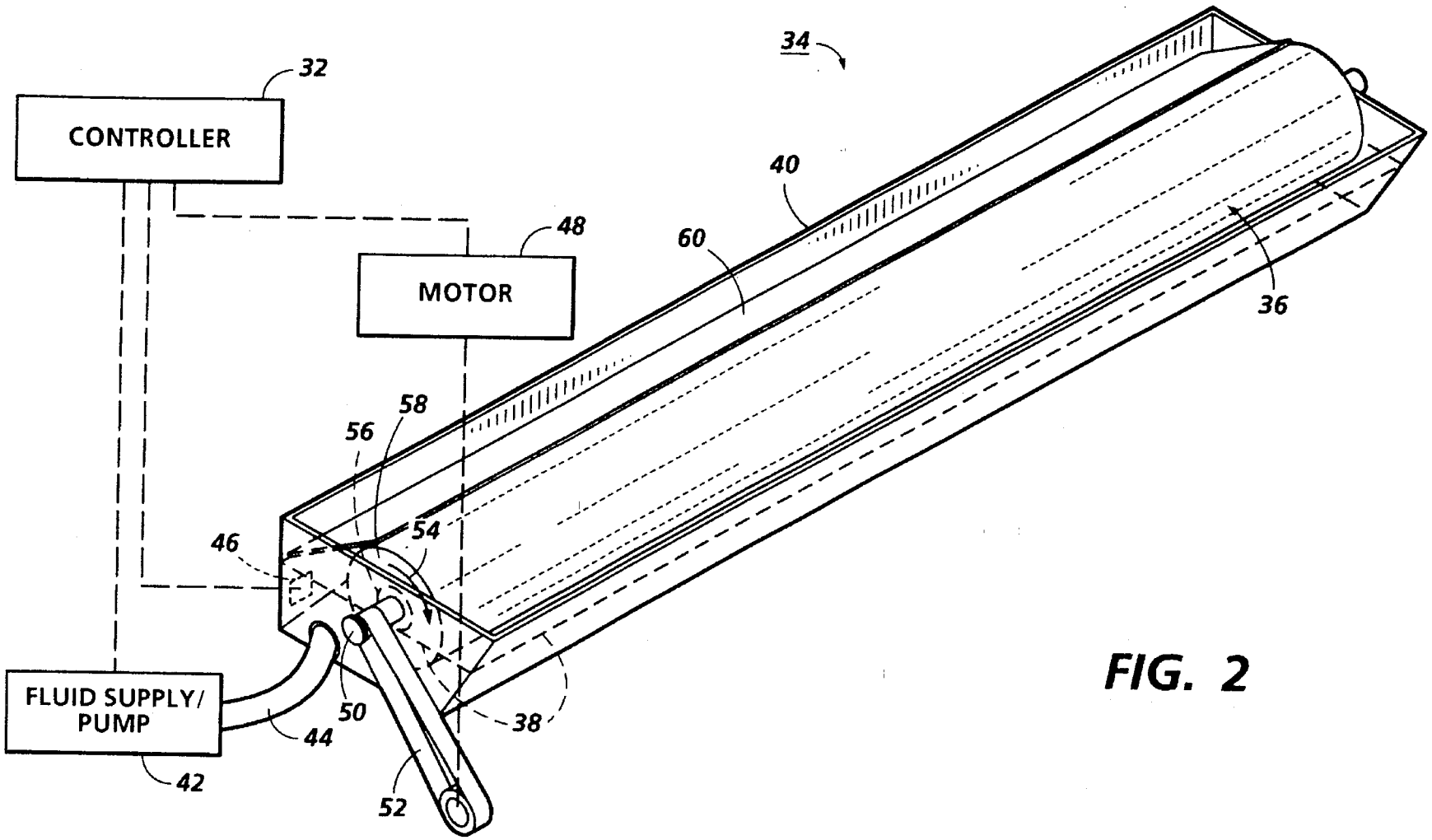
FIG. 2 is a schematic perspective view of one embodiment of the anticurl applicator of the present invention.

FIG. 2 illustrates a partial schematic perspective view of the anticurl material applicator 34. The trough 40 is filled with the anticurl material 38 supplied by a fluid supply/pump 42 through a supply conduit 44 under control of the controller 32. A level sensor 46 connected to the controller 32 senses the level of the fluid 38 in the trough 40.

The roller 36 is rotated under control of the controller 32 by a motor 48 coupled to a roller spindle 50 through a belt 52. The roller 36 rotates in the direction of the arrow 54 which is the same direction in which the belt 12 travels across the top of the roller 36 as illustrated in FIG. 1.

The roller 36, as illustrated in FIG. 2, includes a solid core 56 which can be made of any solid material such as metal or plastic. The solid core 56 extends the width of the transport belt 12, or at least the width of the sheet of paper being printed. A hollow cylinder of foam 58 surrounds the outer circumference of the solid core 56 and extends the length of the solid core 56. The foam cylinder 58 can be of any number foam materials having open cells which absorb or hold a fluid when placed in contact therewith. As the foam cylinder 58 rotates in the direction 54, the foam cylinder comes in contact with the liquid 38 to absorb a certain amount thereof. While the roller 36 rotates, a metering blade 60, made of rubber, plastic or metal and attached to the trough 40 contacts the cylindrical foam roll 58 thereby controlling the amount of anticurl material 38 retained by the cylinder 58.

During operation, the controller 32 controls whether or not the applicator 34 is in contact with the belt 12 to deposit the anticurl material 38 thereon. If, for instance, a simplex sheet of paper is being printed, but the paper will be printed with a standard amount of text, the applicator 34 does not contact the belt 12. The same will also hold true for the printing of duplex sheets. If, however, heavy text, graphics or graphics including full color is being printed, the applicator 34 moves into contact with the belt 12. When in contact with the belt 12, the foam cylinder 58 deposits the anticurl material 38 on the side of the belt 12 which will face the unprinted side of the sheet of paper. If it is known that a number of simplex printed sheets are to be printed, the roller 36 can be in constant contact with the belt 12. However, if a single sheet of simplex printed material is being printed, the controller 32 deposits the anticurl material on the belt at the anticipated point of contact with the printed sheet.

It is preferred that the transport belt is comprised of a material having a rough and/or porous surface capable of holding the anticurl fluid deposited on the belt. By having a slightly porous and/or rough surface, the anticurl material is not deposited directly to the back side of the printed sheet 20 as the printed sheet comes in contact with the belt. Instead, the anticurl material 38 is changed to steam when the paper and moistened belt enter the dryer. In this method, the reverse stress necessary to counteract the printing on the top surface of the sheet is induced primarily by the vapor or steam resulting from the anticurl material as it is heated during transport through the dryer 26. The application of steam to the backside of the sheet of paper which has been printed creates an even distribution of the anticurl fluid to the back side. Any excess fluid transformed to steam is removed by the vacuum applicator 28.

Figure 3:
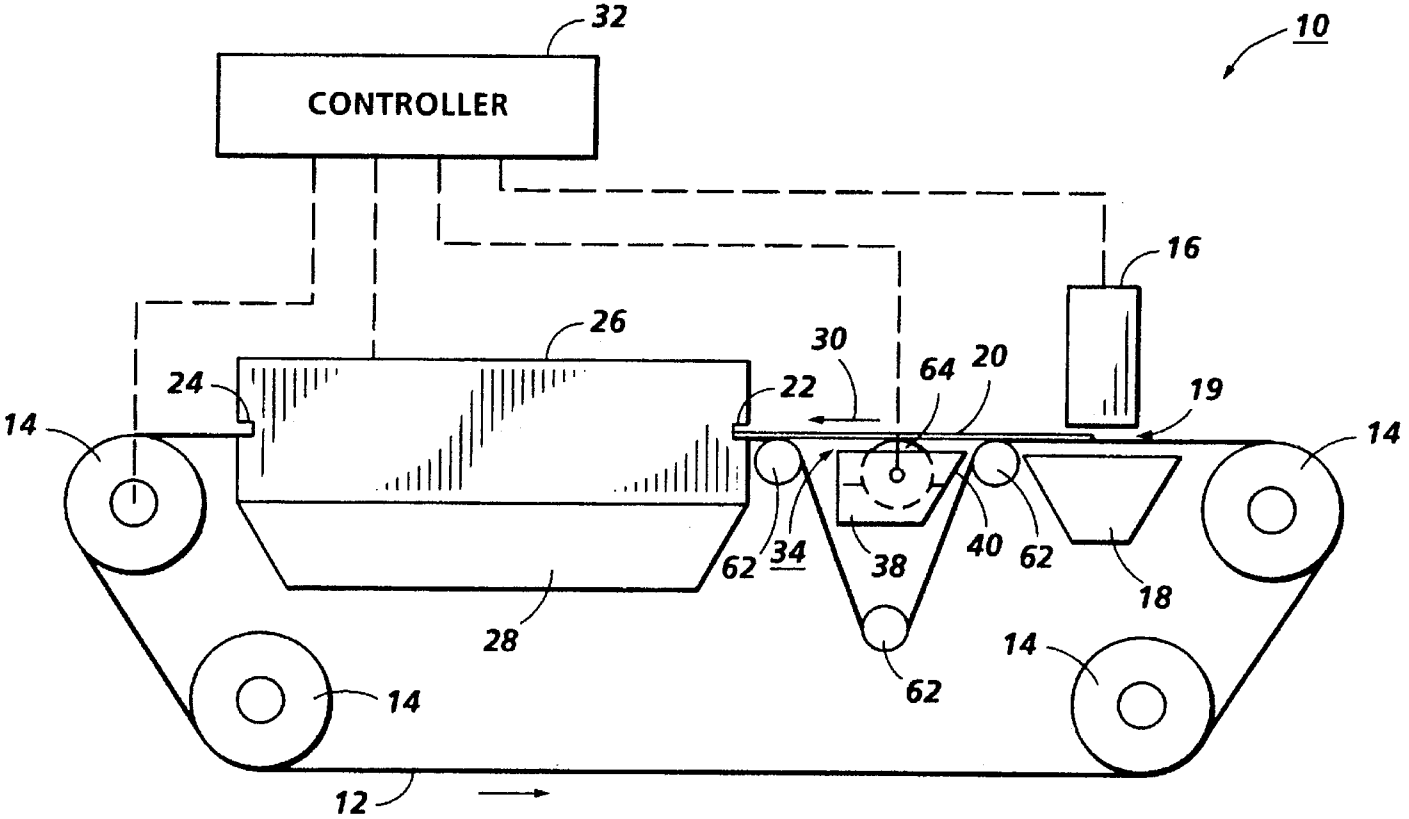
FIG. 3 is a schematic side elevational view of another embodiment of an ink-jet printer having an anticurl applicator.

FIG. 3 illustrates a second embodiment of the present invention. In this embodiment, the roller applies the anticurl fluid directly to the back side of the printed sheet 20. The applicator 34 is located directly in line with the paper transport direction 30. A gap, in the paper transport direction 30 after the printhead 16, is created by a plurality of rollers 62 which direct the belt 12 away from the paper path 30 for a distance of approximately 1.5 inches. This gap size is sufficiently small so that the printed sheet 20 does not lose the vacuum holddown supplied by the vacuum applicator 18 and the vacuum applicator 28. The applicator 34 is disposed in the gap for application of the anticurl material 38.

Figure 4:
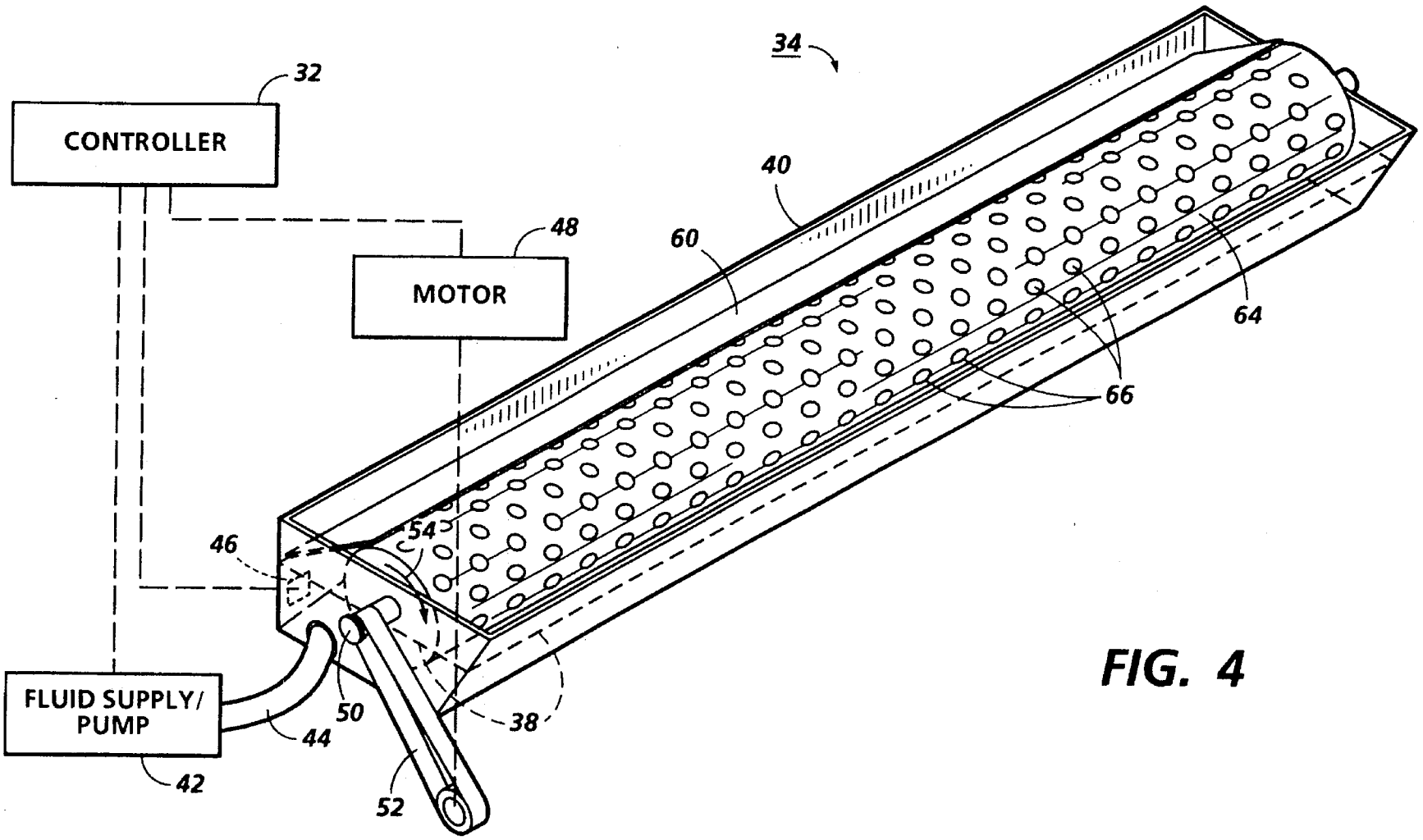
FIG. 4 is a schematic perspective view of a second embodiment of the anticurl applicator of the present invention.

FIG. 4 illustrates a second embodiment of the applicator 34 which, while differing in a few respects from the previously described applicator of FIG. 2, is interchangeable with the applicator 34 as illustrated in FIG. 2 and vice versa. The applicator 34 of FIG. 4 includes a roller 64 having a plurality of dimples 66 disposed thereon. The dimples 66 form a plurality of recesses disposed in the outer surface of the roller 64, each of which hold the anticurl material 38. The roller 64 can be made of any number of materials including metals, plastics or rubber. As the roller 64 rotates in the direction of the arrow 54, the metering blade 60 removes any excess fluid which might adhere to the surface of the roller 64 between the dimples so that the desired amount of anticurl material 38 is deposited on the back side of the printed sheet 20.

Figure 5:
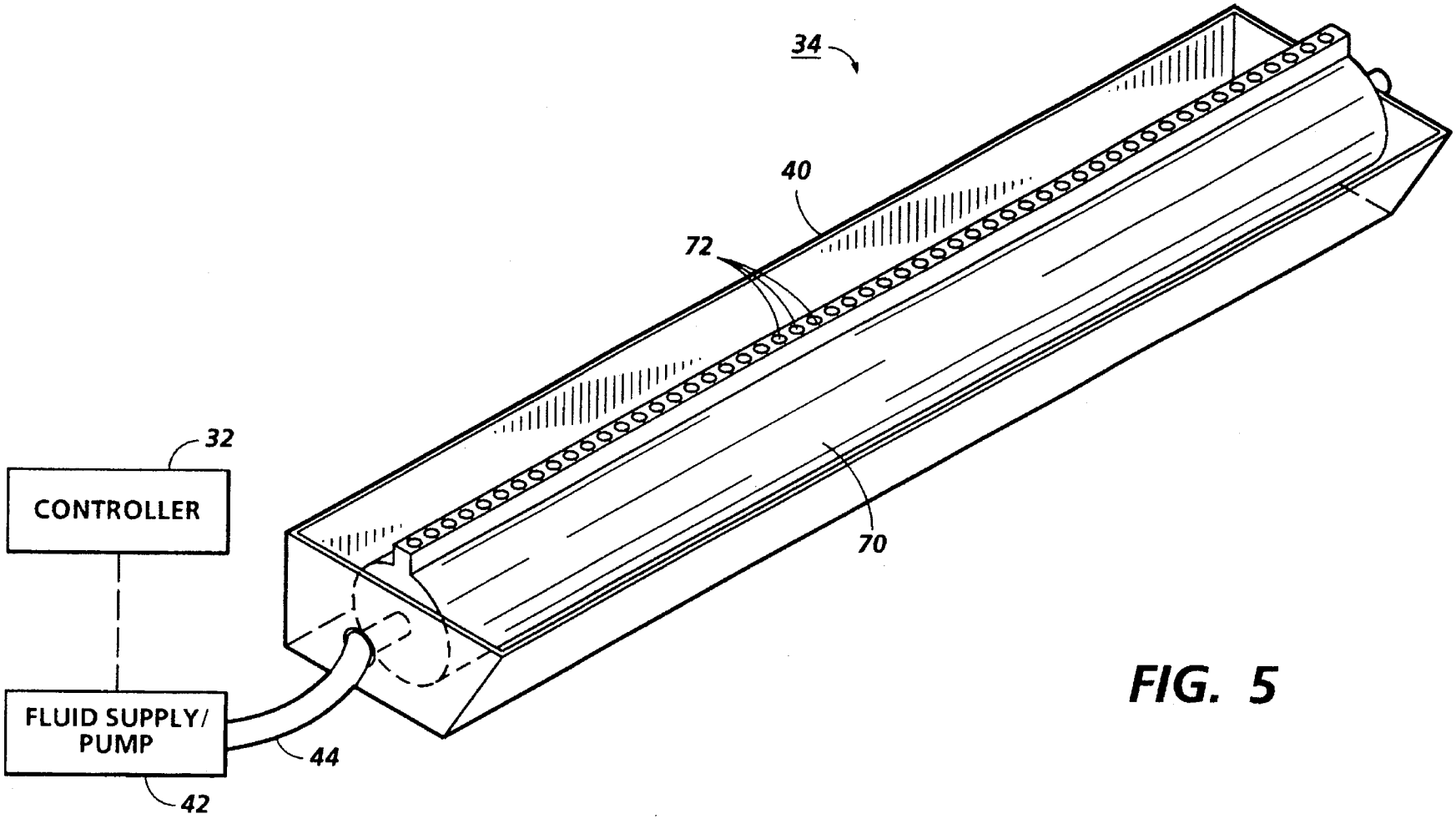
FIG. 5 is a schematic perspective view of another embodiment of the anticurl applicator of the present invention.
Figure 6:
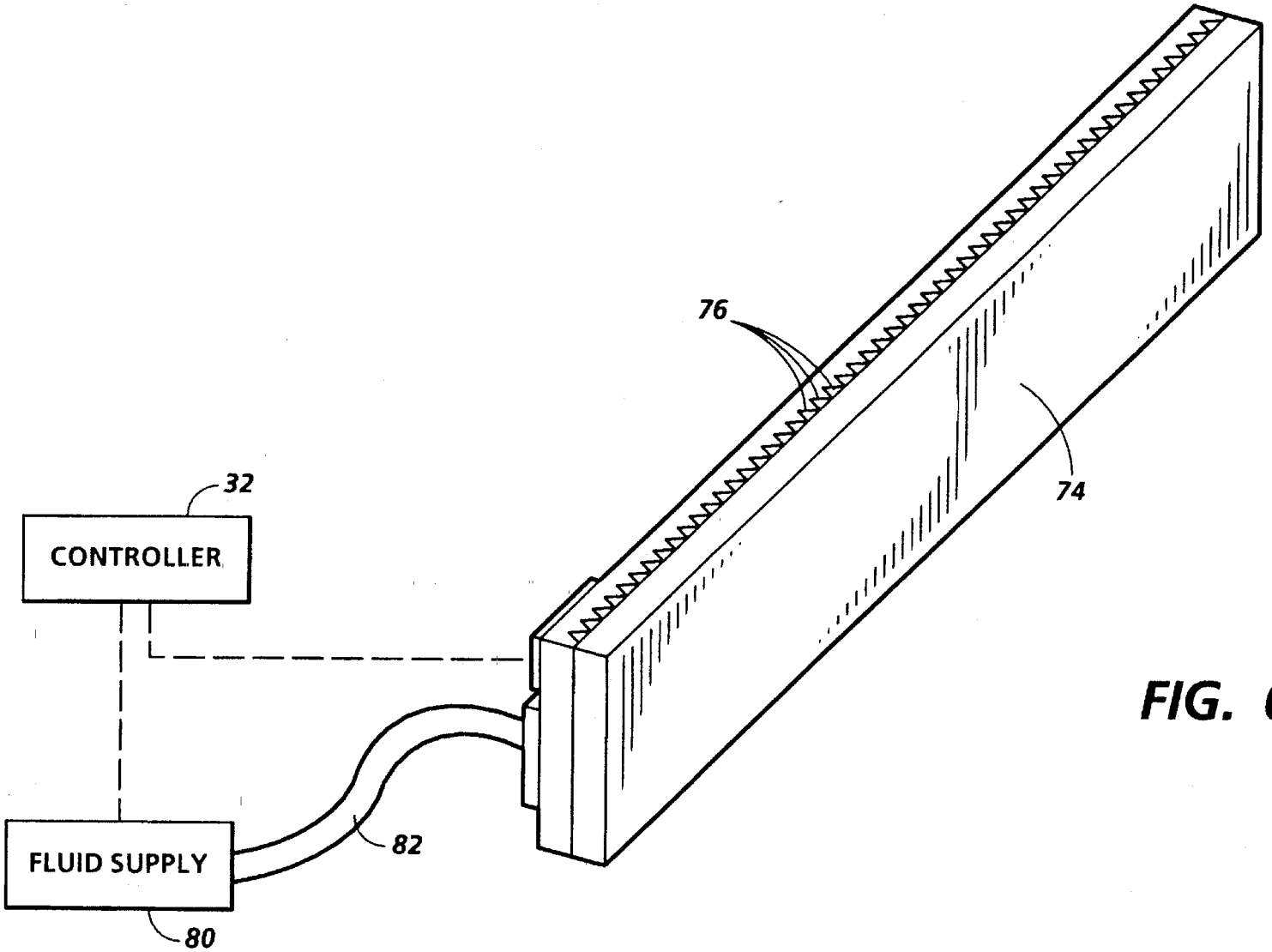
FIG. 6 is a schematic perspective view of one embodiment of the anticurl applicator of the present invention.

In addition to the previously described applicators 34 having rollers 36, FIG. 5 illustrates another embodiment of the applicator 34 which emits dispersed droplets of the anticurl fluid in a fine mist or spray of droplets. The fine spray of liquid is ejected from a pressurized container 70 or sprayer having a plurality of nozzles 72. The anticurl material 38 is supplied to the sprayer 70 through a conduit 44 from the fluid supply/pump 42. The nozzles 72 are spaced along the width of either the printed sheet 20 or the belt 12 and are spaced accordingly to provide full coverage of the anticurl material on the back side of the sheet 20. The trough 40 catches any excess spray.

It is also possible to use a page width thermal ink jet printhead 74 having a linear array of nozzles 76 ejecting anticurl fluid in place of the sprayer 70 or any of the previously described applicators. By using a pagewidth printhead, the application of the anticurl material can be selectively applied to the back side of the printed sheet 20. The controller 32 controls selective application of the anticurl fluid of the anticurl fluid supplied from a fluid supply 80 over a fluid conduit 82.

For instance, if only a small portion of the printed sheet is covered with a large quantity of ink, it might be necessary to only apply the anticurl material to a localized area on the back side of the printed sheet 20. In this way, the sheet does not develop a curl away from the image which might occur if the back side of the sheet 20 were completely covered with anticurl material. A pagewidth printhead suitable for use in the present invention is described in U.S. Pat. No. 4,829,324 entitled "Large Array Thermal Ink-Jet Printhead" assigned to Xerox Corporation.

It is, therefore, apparent that there has been provided in accordance with the present invention, an apparatus and a method for controlling curl on a sheet printed with liquid ink. While the invention has been described in conjunction with a specific embodiment thereof, it is evident that many alternatives, modifications, and variations will be apparent to those skilled in the art. For instance, the present invention is not limited to printing machines having microwave dryers but can be used in any printing machine having active drying such as infrared drying and conductive heating. Likewise, the method and apparatus disclosed for applying the anticurl material is not limited to those disclosed and other mechanisms such as brushing are also possible. Accordingly, the present invention is intended to embrace all such alternatives, modifications, and variations that fall within the spirit and broad scope of the appended claims.

What is claimed is:

1. A printing machine of the type in which liquid ink is deposited on a surface of a recording medium moving along a path, comprising:

a transport belt supporting the recording medium moving along the path;

an applicator, disposed adjacent to the transport belt, depositing an anticurl material on a surface of said transport belt; and a dryer, disposed adjacent to said transport belt, heating the anticurl material to a gas substantially simultaneously with drying of the liquid ink.

2. The printing machine of claim 1, wherein said applicator comprises a roller.

3. The printing machine of claim 2, wherein said roller comprises a fluid absorbent material absorbing to absorb the anticurl material.

4. The printing machine of claim 2, wherein said roller contacts said transport belt.

5. The printing machine of claim 4, further comprising a receptacle surrounding at least a portion of said roller.

6. The printing machine of claim 5, further comprising a metering blade in contact with said roller controlling the amount of anticurl material on said roller.

7. The printing machine of claim 6, wherein said receptacle stores a supply of the anticurl material.

8. The printing machine of claim 6, wherein said receptacle stores a supply of liquid anticurl material.

9. The printing machine of claim 8, wherein the liquid anticurl material comprises water.

10. The printing machine of claim 8, wherein the liquid anticurl material comprises a humectant.

11. The printing machine of claim 10, wherein the humectant is selected from the group consisting of diethylene glycol, ethylene glycol, sulfolane, glycerine, polyethylene glycol, or trimethylol propane.

12. The printing machine of claim 8, wherein the liquid anticurl material comprises a substantially clear liquid ink.

13. The printing machine of claim 1, wherein said applicator comprises a spraying device.

14. The printing machine of claim 13, wherein said spraying device sprays a liquid anticurl material.

15. The printing machine of claim 1, wherein said dryer comprises a microwave dryer, including an input and an output, said transport belt disposed between said input and said output.

16. The printing machine of claim 1, wherein said transport belt comprises a material including a rough surface.

17. The printing machine of claim 1, wherein said transport belt comprises a material including a porous surface.

* * * * *